United States Patent [19]

Takagi et al.

[11] Patent Number: 5,048,545

[45] Date of Patent: Sep. 17, 1991

[54] SMOKING DEVICE

[75] Inventors: Seiichi Takagi; Takako Takagi, both of Tsuchiura; Yuichi Takagi, Isehara, all of Japan

[73] Assignees: Seiichi Takagi; Takako Takagi, Japan; a part interest

[21] Appl. No.: 464,357

[22] Filed: Jan. 12, 1990

[30] Foreign Application Priority Data

Jan. 16, 1989 [JP] Japan ..... 1-6522
Apr. 2, 1989 [JP] Japan ..... 1-83370

[51] Int. Cl.[5] ..... A24F 7/00; A24F 7/02; A24F 47/00

[52] U.S. Cl. ..... 131/330; 131/175; 131/178; 131/189; 131/206; 131/215.1; 131/215.3; 131/216

[58] Field of Search ..... 131/329, 215.1, 270, 131/330, 175, 178, 189, 215.3, 216, 256, 206

[56] References Cited

U.S. PATENT DOCUMENTS

| | | | |
|---|---|---|---|
| 3,757,801 | 9/1973 | Breslow et al. | 131/330 |
| 3,994,307 | 11/1976 | Loeffler | 131/330 |
| 4,200,114 | 4/1980 | Waite . | |
| 4,580,583 | 4/1986 | Green | 131/330 |

*Primary Examiner*—V. Millin
*Attorney, Agent, or Firm*—Volpe & Koenig

[57] ABSTRACT

According to a smoking device of the present invention, major and a minor smoke streams given out during smoking are temporarily stored in a storage section by means of a forcible sucking device. The storage section is taken out to the outdoors later, and the stored smoke is exhausted. The forcible sucking device comprises fans, a pump, or the like, or it utilizes the gravitational force or spring force.

16 Claims, 6 Drawing Sheets

SMOKING DEVICE

BACKGROUND OF THE INVENTION

1. Field of the Invention

The present invention relates to a smoking device wherein major and minor smoke streams of cigarettes are temporarily collected into a gas collecting section.

2. Description of the Related Art

As means for removing major and minor smoke streams of cigarettes, there are known methods utilizing adsorbents or minus-ion chemical change. However, in these conventional methods, only smoke particles are removed, and poisonous gas such as CO gas cannot be removed.

On the other hand, there is proposed a method of exhausting smoke to the outdoors through a pipe. However, in order to put this method to practical use, a high cost is involved and, from the aesthetic viewpoint, this method is undesirable.

According to experiments carried out with the use of a device shown in FIG. 4A, it was found that major and minor smoke streams of one cigarette were sufficiently collected in a container with a volume of about 5 l. For example, a cylindrical container having a diameter of 20 cm and a height of 20 cm is sufficient. Since the space for installing this container is very small, it can be used in a house or an office. The inventor paid attention to this novel fact that the smoke of a cigarette can collected in a relatively small space.

SUMMARY OF THE INVENTION

According to the present invention, major smoke (exhaled from the lamp) and minor (produced from the burning portion of a cigarette) smoke streams are temporarily collected in a gas collecting section so that they can be prevented from floating in a room. The gas collecting section is put to the outdoors later, and the smoke is exhausted.

DETAILED DESCRIPTION OF THE PREFERRED EMBODIMENTS

Preferred embodiments of the present invention will now be described with reference to the accompanying drawings.

Figure 1A:
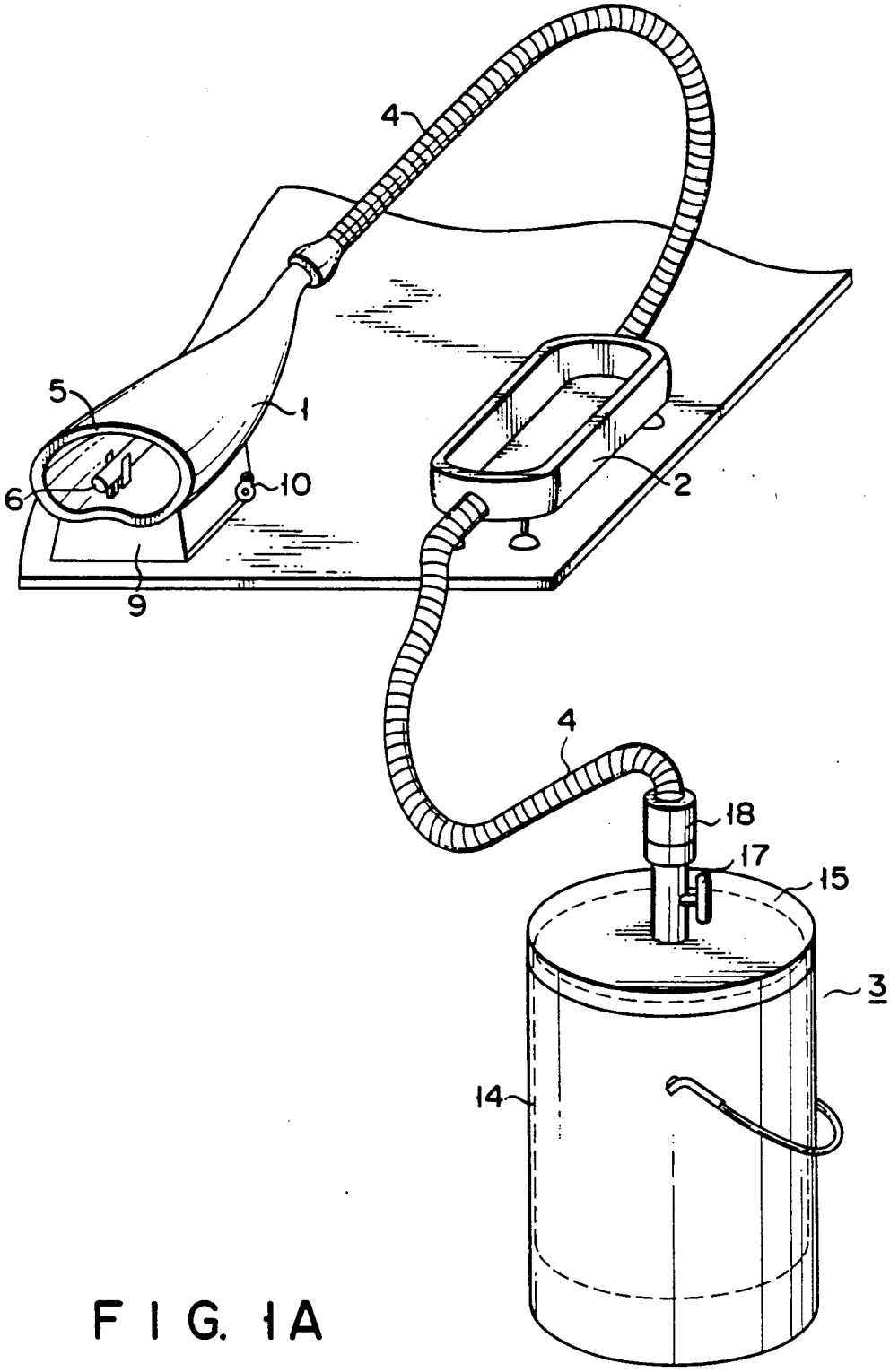
FIGS. 1A to 1E schematically show a smoking device according to an embodiment of the present invention.

FIG. 1A is a perspective view that schematically shows a smoking device according to an embodiment of the present invention.

The smoking device comprises an inhale section 1, an air blowing section 2, a storage section 3, and a pipe 4 for connecting these sections. The inhale section 1 has a cylindrical shape. An opening 5, which is formed at one end of the inhale section 1, is put in contact with the mouth at the time of smoking. Thus, the opening 5 has a shape corresponding to the mouth, and an edge portion of the opening 5 is covered with a soft rubber cushion for attaining soft contact. The inhale section 1 has, at the other end, a portion with a diameter slightly smaller than that of the pipe 4, so that the inhale section 1 can be fitted in the pipe 4.

Figure 1B:
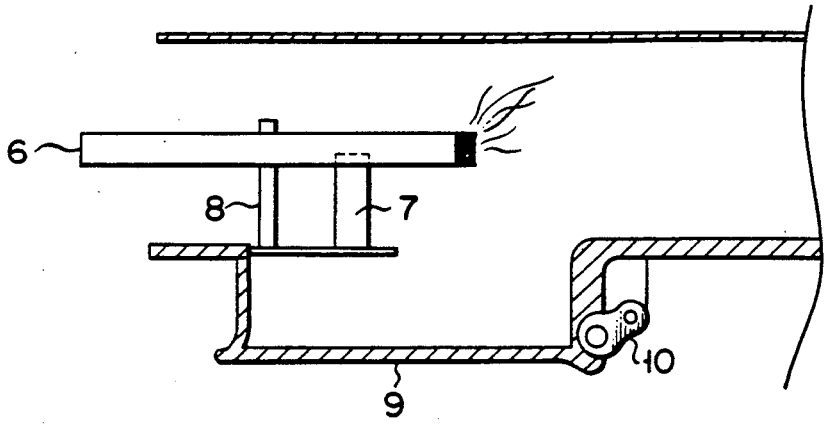
Figure 1C:
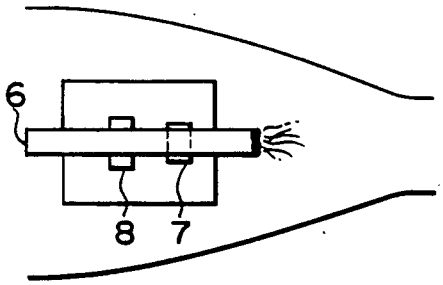
Figure 1D:
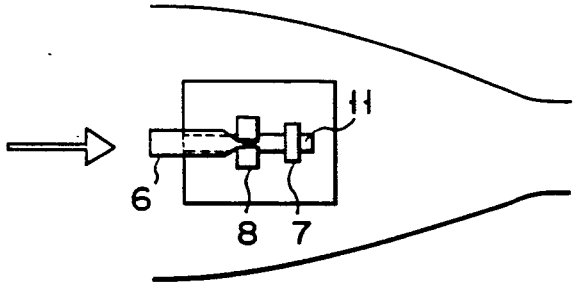

As shown in FIG. 1B, the inhale section 1 includes a support member 7 for supporting a cigarette 6, and a fire extinguishing device 8 for putting out the cigarette 6 when the length of the cigarette 6 is reduced to a predetermined value. FIG. 1C is a horizontal cross-sectional view of the inhale section. As shown in FIG. 1C, the fire extinguishing device 8 is formed of a two-directional shape memory alloy. The device 8 holds both sides of the cigarette 6, and pinches it at high temperature. When a lit end portion of the cigarette 6 approaches the fire extinguishing device or shape memory alloy 8, the alloy 8 pinches and puts out the cigarette 6, as shown in FIG. 1D, by virtue of high temperature. An ashtray section 9 for receiving ash of the cigarette 6 is arranged below the inhale section 1. The ashtray section 9 is openable. Namely, the ashtray section 9 is rotatable about a movable fixing member 10. Thus, the ash accumulated on the ashtray 9 can be disposed of. An opening is formed in that portion of the bottom of the inhale section 1, which is located above the ashtray section 9, so that ash of the cigarette may fall on the ashtray section 9. As shown in FIG. 1B, the cigarette support member 7 and fire extinguishing device 8 are attached on a support shaft 11 which horizontally projects into the space above the ashtray section 9.

The shape memory alloy may be a one-directional one or all-directional one.

Figure 1E:
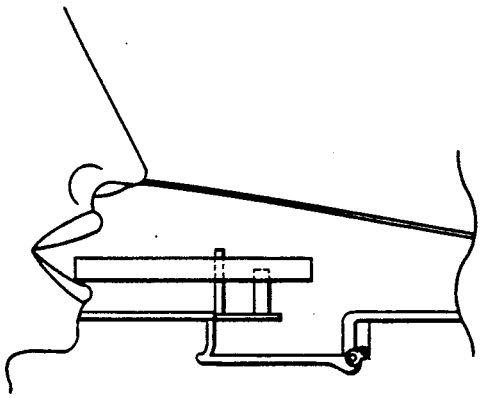

The opening of the inhale section 1 may cover the nose of a smoker, as shown in FIG. 1E, so as to take in the smoke given out from the nose. Though not shown, it is possible that the inhale section is provided on an ashtray so as to take in only minor smoke streams.

Figure 2:
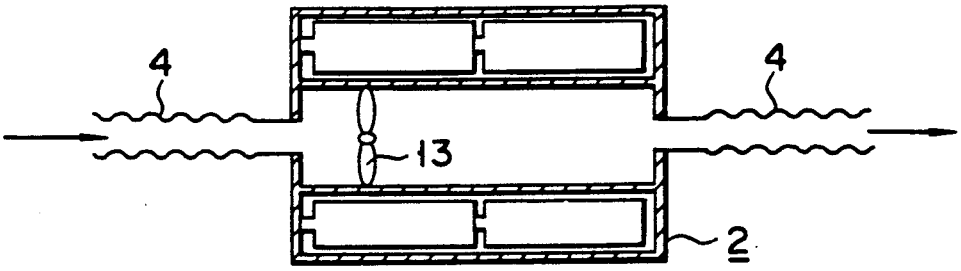
FIG. 2 is a vertical cross-sectional view showing the inside of an air blowing section shown in FIG. 1.

FIG. 2 is a horizontal cross-sectional view of the air blowing section 2, which is of the fan type and may be powered by a rechargeable or non-rechargeable battery. A fan 13 is driven to take in major and minor smoke streams from the inhale section 1 through the pipe 4. An upper surface of the air blowing section 2 is shaped flat, or shaped so that the inhale section 1 can be mounted on the upper surface. When the smoking device is not used, the inhale 1 can be mounted on the air blowing section 2; thus, the space of installation of the device can be saved. The fan-type air blowing section 2 may be replaced with any means, such as a pump, which is capable of sucking the smoke of cigarettes.

Figure 3:
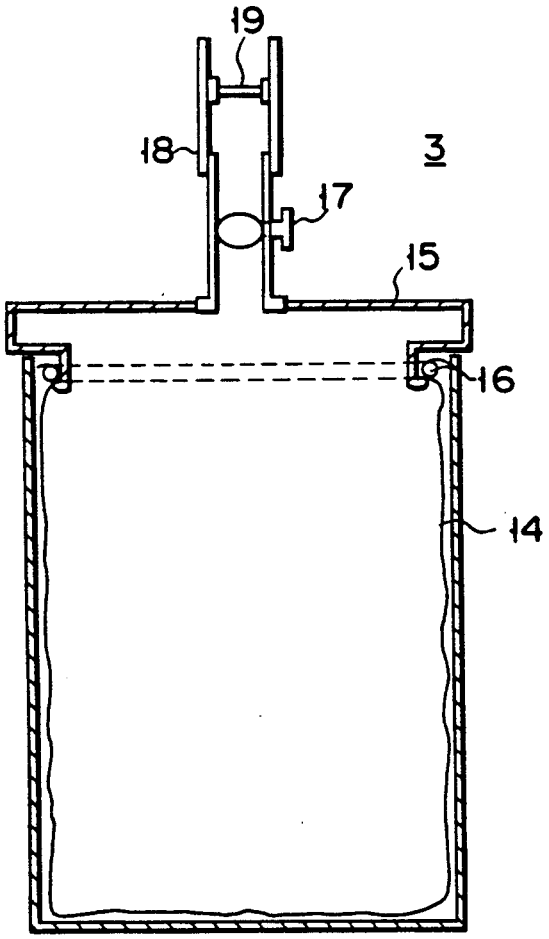
FIG. 3 is a vertical cross-sectional view showing a storage section shown in FIG. 1.

FIG. 3 is a vertical cross-sectional view for schematically showing the storage section 3. The inhaled smoke is stored in a bag 14 formed of plastic material or metal lamination material. An upper end portion of the bag 14 is fixed at an inwardly projecting portion of a cover 15 of a outer casing. An upper region of the cover 15 is provided with a cock 17. An end portion of the cock 17 and the pipe 4 ar removably coupled by a joint 18. An elastic valve 19 is provided in that part of the pipe 4, which is close to the joint 18.

The above-described smoking device is operated in a manner stated below.

First, the cigarette 6 is mounted on the support member 7. The ashtray section 9 is opened downward, and the cigarette 6 is lit through the produced opening. Then, the ashtray section 9 is closed. Then, the cock 17 is opened, and the fan 13 is driven. The ashtray section 9 serves as a handle held by the smoker.

The inhale section 1 is put in close contact with the mouth, and the smoker inhales the smoke of the cigarette 6 and then exhales the major smoke stream into the pipe 4. The major smoke stream is stored in the bag 14. In this case, a minor smoke stream is naturally collected in the bag 14 by virtue of the suction force of the fan.

Figures 4A, 4B:
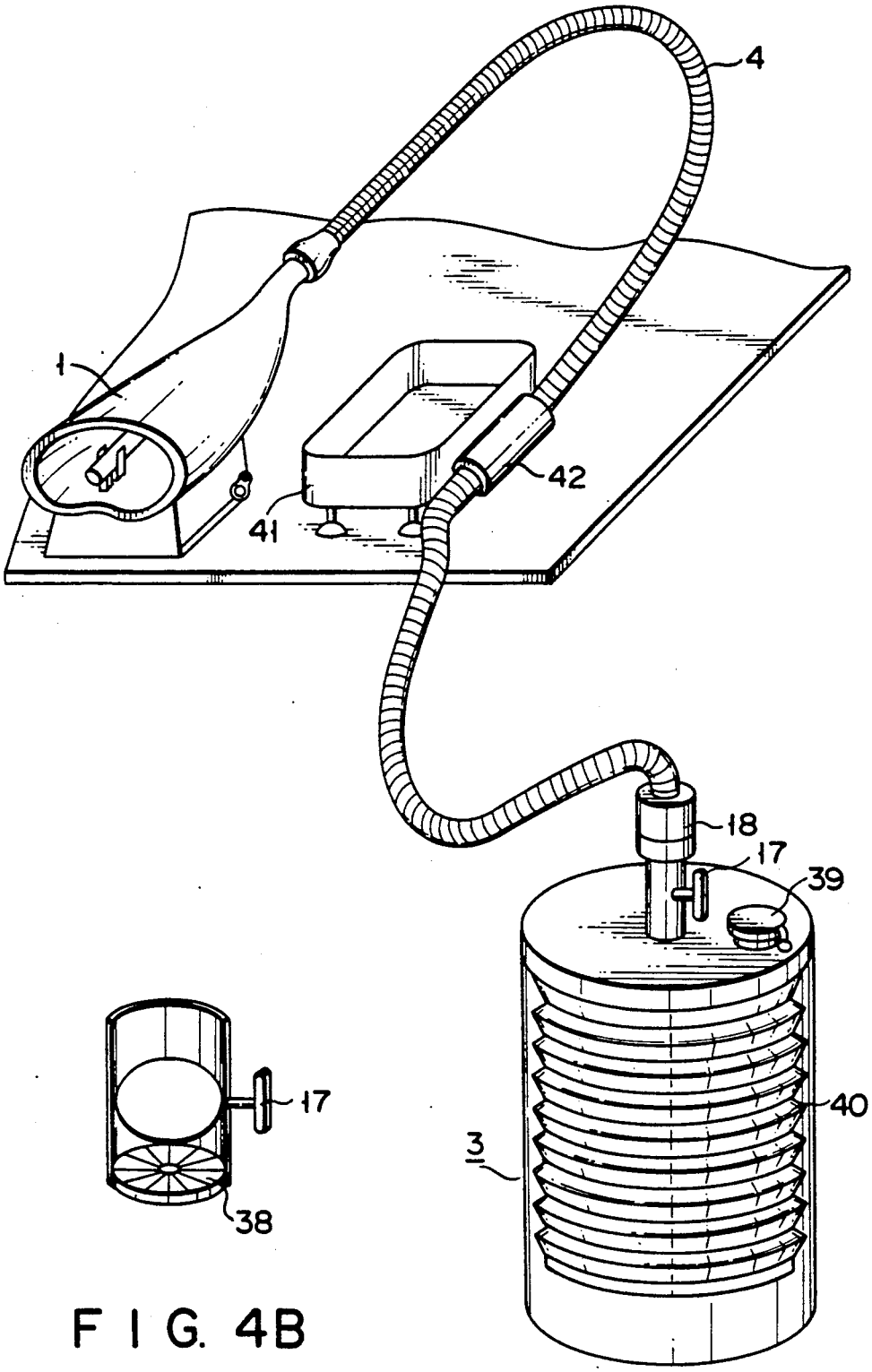
FIG. 4A schematically shows a smoking device according to another embodiment of the present invention.
FIG. 4B schematically shows a cock and a elastic valve of FIG. 4A.

FIG. 4A schematically shows an embodiment using an accordion-type storage device, and not using an air blowing section.

In this embodiment, instead of using the fans, an accordion-type bag 40 made of a light material and free from leakage is arranged in a storage section 3 made of transparent plastic material. An exhaust cap 39 is provided on a cover 15 of the outer casing, so that the bag 40 may be extended or contracted, with air inhale/exhale rate being controllable. As shown in FIG. 4B in detail, an elastic valve 38 is provided below a cock 17. When the smoke is taken in the bag 40 from the mouth, the valve 38 is opened downward. When the smoke is not taken in, the valve 38 is closed to prevent the back flow of smoke.

In this embodiment, the air blowing section is not provided, although the upper portion of the air blowing section is used as a table for mounting the inhale section 1 in the embodiment shown in FIG. 1A. Thus, a mount table 41 with suckers is provided for mounting thereon the inhale section 1 when the smoking device is not used. A fixing ring 42 is attached to one side surface of the table 41. The ring table 41 may be fixed to pipe 4 via the ring 42.

In order that smoke can slowly be taken in the accordion-type bag 40, the bag 40 must be made of a light material. If the bag 40 is made of a thick, strong and heavy material, a spring or an elastic rubber member may be provided to cancel the weight of the bag 40. In other words, such a spring or the like exerts a force so as to contract the bag 40, i.e, in a direction opposite to the direction in which spring 26 shown in FIG. 5 acts. Thus, the rate at which the smoke is taken in can be desirably controlled.

Figure 5:
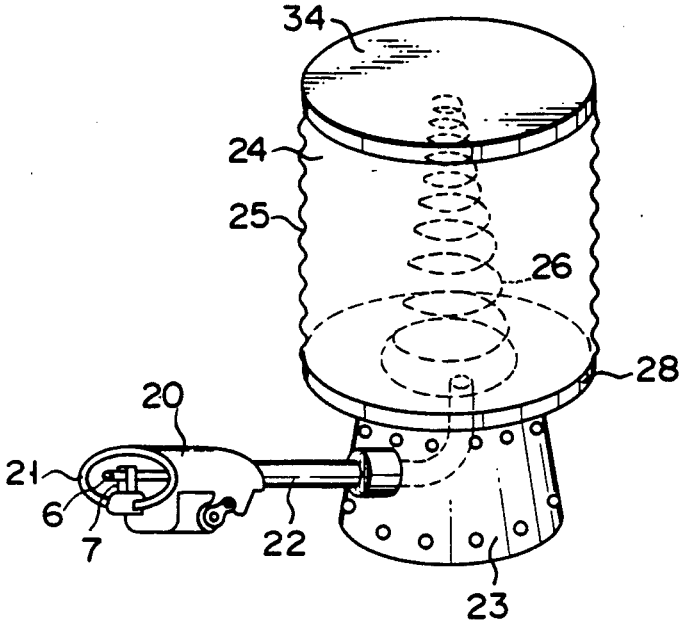
FIG. 5 is a schematic perspective view showing a smoking device according to another embodiment of the present invention.

FIG. 5 shows a smoking device according to another embodiment of the invention, which is not provided with the air blowing section and is designed mainly for household use.

In this embodiment, a cigarette 6 is supported on a support member 7 in a suction pipe 20. A suction section 21 is provided on the suction side. It is desirable that the suction section 21 have an oval, curved shape corresponding to the mouth of a smoker. A foamed cushion material or a rubber cushion material may be attached to a peripheral portion of the suction 21. The suction pipe 20 is formed of a material with high thermal conductivity, such as brass, copper or aluminum, and the surface of the suction pipe 20 is provided with grooves, knurls or fins, thereby efficiently radiating heat produced from the lit cigarette 6. The suction pipe 20 is connected to a gas-collection pipe 22 that is thinner than the suction pipe 20. Namely, the smoke is efficiently collected through the thin pipe. The gas-collecting pipe 22 penetrates through a base section 23 and communicates with a gas collecting section 24. The gas collecting section 24 has a bellows section 25 in which a spring 26 is arranged. By virtue of the action of the spring 26, the gas collecting section 24 takes in gas. In this case, the spring 26 is not necessarily provided. When the spring 26 is not used, the bellows section 25 of the gas collecting section 24 is formed of an elastic material such as rubber or plastics. By virtue of the elastic force of the bellows section 25 itself, the gas collecting section 24 can take in gas.

Figure 6:
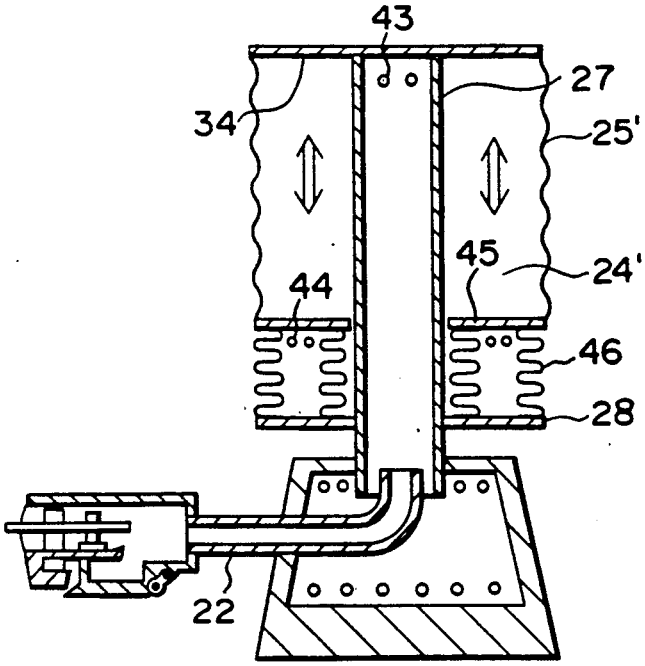
FIG. 6 is a vertical cross-sectional view showing still another embodiment of the present invention.

FIG. 6 shows an embodiment wherein a gas collecting section 24' is provided in the upper part of the storage section to take in gas by virtue of the gravitational force. A gas-collecting bellows section 25' is arranged in an upper peripheral region of an inner cylinder 27 that is connected to a gas-collecting pipe 22. The bellows section 25' is attached to an intermediate flange 45. An extendible sub-bellows section 46, having a smatter outer diameter than the bellows section 25' and arranged close to inner cylinder 27, is provided below the intermediate flange 45. The sub-bellows section 46 is attached to a lower flange 28. Holes 44 communicating with the external atmosphere are formed in the sub-bellows section 46. When the smoking begins, the bellows section 25' is contracted, and the sub-bellows section 46 is extended, whereby the volume in the gas collecting section 24' is reduced to a minimum. Then, by virtue of the gravitational force, the bellows section 25' is extended and the sub-bellows section 46 is contracted, so that the smoke in the inner cylinder 27 is sucked out through the holes 43.

If the size of each hole 44 is sufficiently reduced, the sub-bellows section 46 contracts slowly, and the rate at which the smoke is taken in the bellows section 25' can be controlled.

The sub-bellows section like this is applicable to accordion-type bag in FIG. 4. This sub-bellows section type is convenient for being able to such slowly even if the inhale section should be wide.

Either the sub-bellows section 46 or the bellows section 25' is always contracted, but the entire shape of the storage section comprising the sections 46 and 25' is unchanged. Thus, a big pipe-like shape of the smoking device can be maintained.

Figure 7:
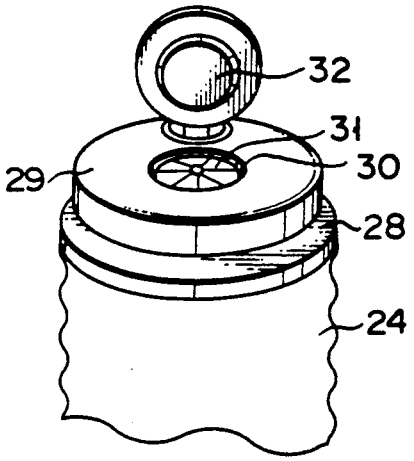
FIG. 7 is a perspective view showing a bottom part of a gas collecting section shown in FIG. 5.

FIG. 7 is a perspective view showing an example of a structure of a lower flange attached to the gas collecting section 24 shown in FIG. 5. An engaging gas-collection hole 30 is formed at a center region of an engaging section 29 that is to be engaged with the base section 23. A valve 31 is provided in the gas-collection hole 30. The valve 31 is elastic and has cuts. When the smoker exhales the major smoke stream, the valve 31 easily opens to increase the amount of taken-in gas. When the smoking is completed and the gas collecting section 24 is removed, a cap 32 is closed to prevent the leakage of smoke. The cap 32 may be replaced with a cock. In this case, the cock may be closed while the smoke is being sucked.

Figure 8:
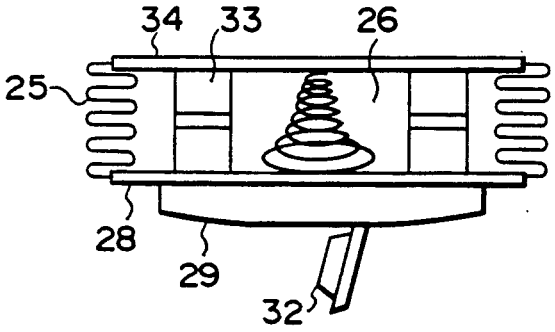
FIG. 8 is a vertical cross-sectional view showing a gas collecting section of a smoking device according still another embodiment of the invention.

FIG. 8 shows an embodiment in which magnets 33 are arranged within the gas collecting section 24 shown in FIG. 5, so that the section 24 can be reduced in size when it is not used. In this case, upper and lower flanges 34 and 28 are attracted to each other by virtue of the magnets 33. Also, a fastener member may be used.

Figure 9:
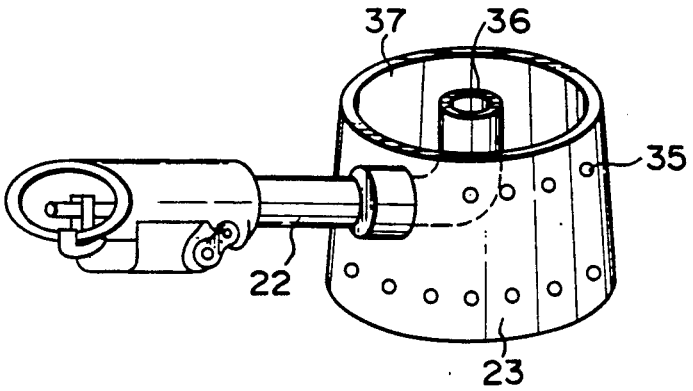
FIG. 9 is a perspective view showing a modification of a base section of the device shown in FIG. 5.

FIG. 9 is a perspective view showing a modification of the base section 23 of the device shown in FIG. 5. Vent holes 35 are formed in the upper and lower parts of the base section, so that overheating of the smoke passage within the base section 23 can be prevented. The peripheral part of the base section 23 may be formed of a punched metal plate or a metal net. Also, a paste-like heat-absorbent may be filled in the base section 23 to prevent overheating. An end portion 36 of the pipe 22 and an upper part 37 of the base section 23 are engaged, respectively, with the engaging section 29 and the engaging gas-collection hole 30 of the lower flange 28 of the gas collecting section 24.

After the smoke is collected by this smoking device, the gas collecting section 24 is removed from the base section 23 and is taken out to the outdoors. Then, the gas collecting section 24 is placed upside down and the cap 32 is opened. As a result, the smoke is naturally discharged from the section 24.

If a plurality of such accordion-type gas collecting sections 24 are prepared, these may be used as cartridges.

As has been described above, according to the smoking device of the present invention, the smoke of cigarettes can be collected completely, and a special piping work is not required. Therefore, problems due to indoor smoking can be solved. This invention is very novel. According to another important aspect of this invention, the smoking device of the invention has high practicability because it is invented based on the fact that the volume of gas required for sucking the smoke of cigarettes is relatively small.

What is claimed is:

1. A smoking device comprising an inhale section for inhaling the smoke of cigarettes therefrom and exhaling the inhaled smoke therein, a gas-sucking device for forcibly sucking a stream of cigarette smoke exhaled from the lungs and a smoke stream of a cigarette produced from the burning portion of a cigarette, and a storage section for storing said smoke streams of at least one cigarette.

2. The smoking device according to claim 1, wherein said inhale section includes an opening, and a cigarette support member, and wherein said inhale section has an ashtray section.

3. The smoking device according to claim 1, wherein said inhale section includes a cigarette extinguishing device made of a shape memory alloy.

4. The smoking device according to claim 1, wherein said inhale section can be mounted on an ashtray section.

5. The smoking device according to claim 1, wherein said gas-sucking device is of a fan type and is provided with a sucker for fixing the position of the gas-sucking device, an upper portion of the gas-sucking device being shaped so that the inhale section can be mounted thereon.

6. The smoking device according to claim 1, wherein said gas-sucking device is of a pump type and is provided with a sucker for fixing the position of the gas-sucking device, an upper section of the gas-sucking device being shaped so that the inhale section can be mounted thereon.

7. The smoking device according to claim 1, wherein said storage section comprises an outer casing, which consists of a cover with a cock and a main body, and a bag contained in the main body and attached to a portion of the cover, said cock being provided in that part of a pipe for guiding smoke into the storage section, which is close to the storage section.

8. The smoking device according to claim 1, wherein said storage section comprises an outer casing, which consists of a cover with the cock, having a pipe with an elastic valve therein, and a main body, and a bag of an accordion type contained in the outer casing.

9. The smoking device according to claim 1, wherein said storage section comprises an accordion-type gas collecting section at its upper part, and an accordion-type bag at its lower part, said accordion-type bag cooperating with said accordion-type gas collecting section and having small-sized exhaust holes.

10. The smoking device according to claim 1, wherein a spring is provided in the storage section.

11. A smoking device comprising an inhale pipe for supporting therein a cigarette such that the entire cigarette, prior to use, is surrounded by the inhale pipe, and an accordion-type gas collecting section attached to an end portion of said pipe.

12. A smoking device comprising cigarette mounting means associated with a gas-sucking device for forcibly sucking a stream of inhaled cigarette smoke exhaled from the lungs and a smoke stream of a cigarette produced from the burning portion of a cigarette, and a storage section for storing said smoke streams of at least one cigarette.

13. A smoking device comprising a gas-sucking device, having therein a cigarette extinguishing device made of a shape memory alloy, for sucking smoke streams of a cigarette, and a storage section for temporarily storing the smoke streams.

14. A smoking device comprising a gas-sucking unit for collecting smoke streams of a cigarette, a gas-sucking device for forcibly sucking the smoke streams, and a storage section for temporarily storing the smoke streams, characterized in that said storage section comprises:

an outer casing consisting of a cover with a cock and a main body, said cock being provided in that part of a pipe for guiding the smoke into the storage section, which is close to the storage section;

and a bag contained in the main body and attached to a portion of the cover.

15. A smoking device comprising a gas-sucking unit for collecting smoke streams of a cigarette, a gas-sucking device for forcibly sucking the smoke streams, and a storage section for temporarily storing the smoke streams, characterized in that said storage section comprises:

an outer casing, which consists of a cover with a cock, having a pipe with an elastic valve therein, and a main body; and a bag of an accordion type contained in the outer casing.

16. A smoking device comprising a gas-sucking unit for collecting smoke streams of a cigarette, a gas-sucking device for forcibly sucking the smoke streams, and a storage section for temporarily storing the smoke streams, characterized in that said storage section comprises an accordion-type gas collecting section at its upper part, and an accordion-type bag at its lower part, said accordion-type bag cooperating with said accordion-type gas collecting section and having small-sized exhaust holes.

* * * * *

PRINTER'S TRIM LINE

UNITED STATES PATENT AND TRADEMARK OFFICE

CERTIFICATE OF CORRECTION

PATENT NO. : 5,048,545

DATED : September 17, 1991

INVENTOR(S) : Seiichi Takagi, et al.

It is certified that error appears in the above-identified patent and that said Letters Patent is hereby corrected as shown below:

At column 1, line 36, delete the word "lamp" and insert therefor --lungs--.

At column 1, line 36, after the word 'minor' insert --smoke--.

At column 1, line 37, delete the word "smoke".

Signed and Sealed this

Twelfth Day of January, 1993

*Attest:*

DOUGLAS B. COMER

*Attesting Officer*

*Acting Commissioner of Patents and Trademarks*